US008016468B2

(12) United States Patent
Tessnow et al.

(10) Patent No.: US 8,016,468 B2
(45) Date of Patent: Sep. 13, 2011

(54) SIGNAL INDICATOR LAMP ASSEMBLY FOR A VEHICLE

(75) Inventors: Thomas Tessnow, Weare, NH (US); Christian Meier, Munich (DE)

(73) Assignee: Osram Sylvania Inc., Danvers, MA (US)

( * ) Notice: Subject to any disclaimer, the term of this patent is extended or adjusted under 35 U.S.C. 154(b) by 185 days.

(21) Appl. No.: 12/592,510

(22) Filed: Nov. 25, 2009

(65) Prior Publication Data

US 2011/0122636 A1 May 26, 2011

(51) Int. Cl.
*F21V 1/00* (2006.01)

(52) U.S. Cl. ..... 362/510; 362/19; 362/293; 362/540; 362/520; 359/872

(58) Field of Classification Search ..... 362/510, 362/520, 540, 293, 19; 359/871, 872
See application file for complete search history.

(56) References Cited

U.S. PATENT DOCUMENTS

| | | | | |
|---|---|---|---|---|
| 4,733,335 | A * | 3/1988 | Serizawa et al. | 362/503 |
| 4,839,553 | A | 6/1989 | Mellor | |
| 5,200,855 | A * | 4/1993 | Meredith et al. | 359/588 |
| 6,369,510 | B1 | 4/2002 | Shaw et al. | |
| 6,478,453 | B2 * | 11/2002 | Lammers et al. | 362/294 |
| 6,661,164 | B2 * | 12/2003 | Ruemmelin et al. | 313/112 |
| 7,176,606 | B2 | 2/2007 | Schaefer et al. | |
| 2009/0122568 | A1 | 5/2009 | McFadden et al. | |

FOREIGN PATENT DOCUMENTS

| | | | |
|---|---|---|---|
| EP | 0460913 | A2 | 12/1991 |
| EP | 0986093 | A1 | 3/2000 |
| FR | 2626981 | A1 | 8/1989 |

OTHER PUBLICATIONS

Product description for Sylvania SilverStar 3757 High Performance Signal Light Bulbs with "Diadem interference coating", www.shopwiki.com/Sylvania+SilverStar+3757+High+Performance+Signal+Light+..., site visited Sep. 30, 2009 (2 pgs.).
Web article "NHTSA Looking to Mandate Rear Turn-Signal Color" requesting public comment dated Jun. 30, 2009. website—http://blogs.car.com/kicking tires/2009, visited Oct. 21, 2009 (1 page).
English translation of EP 0986093 (without claims).
English translation of EP 0986093 obtained from EPO website.
Osram company website describing "Diadem" coating on indicator lights, from www.osram.com/osram_com/Consumer/Automotive_LightingProducts/Signal,obtained Nov. 13, 2009 (2 pages).
Product specification for Osram lamp PY21W 12V 7505 LDA DIADEM ("looks white-light yellow") from website www.svetila.com/en/osram-light-bulbs-and-luminaries-66/automotive-tuning-77, obtained Sep. 30, 2009, (2 pgs.).

* cited by examiner

*Primary Examiner* — Ali Alavi
(74) *Attorney, Agent, or Firm* — Edward S. Podszus

(57) ABSTRACT

A signal indicator lamp assembly (10) for a vehicle (14) has an LED assembly (16) that emits electromagnetic radiation (20), which is visible light, such as white light, that is composed of at least two wavelengths. A collimating optic (18) is positioned forwardly of the LED assembly (16) for providing substantially parallel light rays of the emitted radiation (20). A second optic (22) is positioned forwardly of the collimating optic (18), the second optic (22) having a first planar surface (33) facing the collimating optic (18) and a second, outer surface (35), the first planar, surface (33) having an interference coating (24) thereon, the interference coating (24) reflecting back toward the LED assembly (16) at least some of the first wavelengths (31) of the radiation (20) and transmitting at least some of the second wavelengths (39).

11 Claims, 4 Drawing Sheets

SIGNAL INDICATOR LAMP ASSEMBLY FOR A VEHICLE

TECHNICAL FIELD

This application relates to automotive lighting and particularly to signal indicators and still more particularly to turn signal indicator lamp assemblies for the forward or front portion of the vehicle.

BACKGROUND ART

The forward facing turn signal lamps of automotive vehicles have two separate and distinct aspects. A first aspect is purely functional; that is, the lamp must provide sufficient illumination for its intended purpose under both normal and adverse conditions. Standards for such conditions are generally set by one or more governmental agencies and are adhered to by automotive designers and lamp manufacturers.

The second aspect is that of appearance; that is, the lamp unit must not only be functional but aesthetically pleasing to designers and customers alike.

Front or forward lighting signal lamps have to endure environmental temperatures of up to 105 degrees centigrade. If they are positioned close to the headlamps, the photometric requirements can be up to 2.5 times higher than for lamps positioned further away. For many years the practice has been to employ a conventional incandescent lamp for this purpose and, to distinguish the signal lamp from the normal vehicle headlamps, to use a colored lens in front of the lamp, usually yellow. When the automotive industry decided, for aesthetic reasons, to use clear lenses, it was necessary to develop lamps that emitted in the yellow region of the visible spectrum. This was accomplished by applying a coating to conventional P21 and S8 incandescent lamps, the coating reflecting blue and green light but transmitting yellow light. Such a dichroic interference coating applied to incandescent lamps are shown in European laid-open specification EP 0 986 093 A1 (Bodmer). Dichroic coatings are those coatings which will selectively transmit some wavelengths while reflecting others. Commercial embodiments of such coatings are sold by Osram or Osram Sylvania with the trademark "Diadem" for lamps with an interference coating having an opal appearance when unlit and an amber appearance when lit. A coating on an incandescent bulb that transmits red light while reflecting blue and green light is disclosed in U.S. Pat. No. 6,661,164 (Ruemmelin).

Other bulb coatings are shown in U.S. Pat. Nos. 7,176,606 (Schaefer), and 5,200,855 (Meredith). U.S. Pat. No. 6,369,510 B1 (Shaw) teaches a blue tinted lamp coating on a lamp capsule. U.S. Pat. No. 4,839,553 (Mellor) discloses an arrangement of a reflector lamp and curved lamp both with dichroic coatings Light emitting diodes (LEDs) have been suggested as possible alternatives for the incandescent lamps and yellow emitting LEDs (comprised of AlInGa) do exist; however, these materials exhibit a strong decrease in light output with increasing temperatures. At the postulated 105 degree centigrade environmental temperatures encountered near the front lights of vehicles, these LEDs cannot survive without displaying a strong thermal roll-off of 40% or more.

White-light emitting LEDs are available; however, the use of white-emitting LEDs for turn signal applications would require the use of a yellow filter, resulting in the very appearance (a yellow unlit look) that manufacturers do not want. Such a technique is shown in U.S Published Patent Application No. 2009/0122568, which teaches the application of white light emitting LEDs and colored filters to provide the necessary amber illumination of turn signal indicators.

The prior art thus fails to provide turn signal indicators presenting a first color when not illuminated and a second, necessary color when they are illuminated.

DISCLOSURE OF INVENTION

It is, therefore, an object of the invention to enhance the operation of vehicle signal lights.

It is yet another object of the invention to improve the appearance of vehicle signal lights.

It is another object of the invention to provide a signal indicator that presents different colors when illuminated and not illuminated.

These objects are accomplished, in one aspect of the invention, by the provision of a signal indicator lamp assembly for a vehicle that employs an LED assembly that emits electromagnetic radiation when operating, the electromagnetic radiation being visible light, preferably white light, the electromagnetic radiation comprising at least a first wavelength and a second wavelength. A collimating optic is positioned forwardly of the LED assembly for providing substantially parallel rays of the emitted electromagnetic radiation. A second optic is positioned forwardly of the collimating optic. The second optic has a first planar surface facing the collimating optic and a second, outer surface. The first planar surface has an interference coating thereon, the interference coating reflecting back toward the LED assembly at least some of the first wavelengths of the emitted electromagnetic radiation and transmitting at least some of the second wavelengths of the emitted radiation.

These objects are accomplished in a specific embodiment of the invention in a turn signal indicator for a vehicle wherein the emitted electromagnetic radiation includes those wavelengths normally associated with white light, for example, those wavelengths between about 380 to 750 nm. The first wavelength includes radiation in the blue-green region (380-560 nm) and the second wavelength includes radiation in the yellow-orange region (520-570 nm), which is sometimes referred to as amber light.

This system provides all of the advantages of LED operation, together with the desired aesthetic appeal of blue-ish appearance to the turn signal light when it is not operating and a visible yellow illumination when it is operating.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 4:
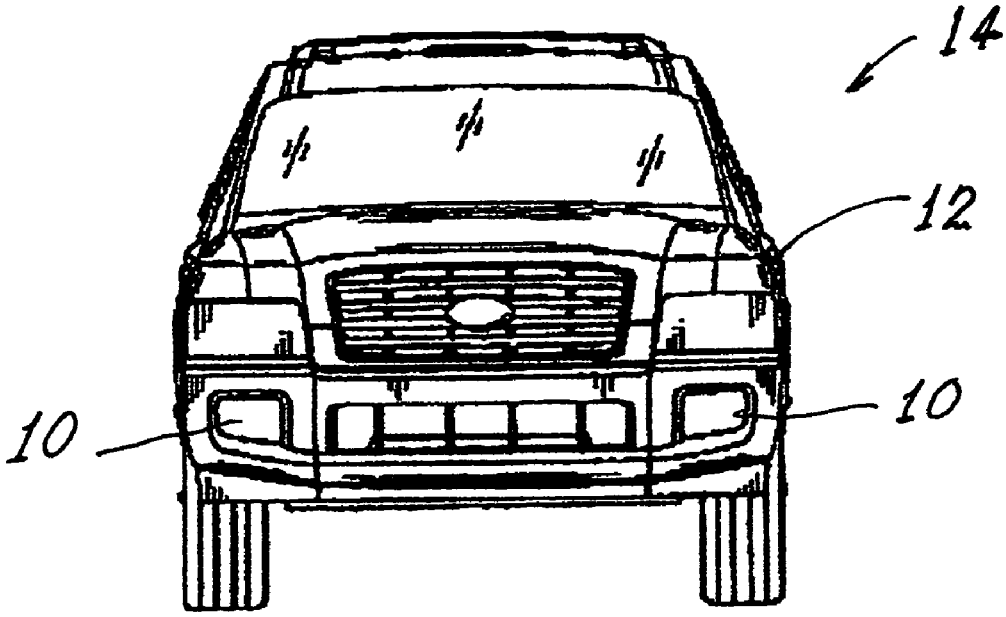
FIG. 4 is a front view of an automotive vehicle that can use the invention.

Referring first to FIG. 4, there is shown a turn signal indicator lamp assembly 10 for the forward portion 12 of a vehicle 14. The lamp assembly 10 provides a blue-ish color when unlit and a strong yellow color when illuminated.

Figure 1:
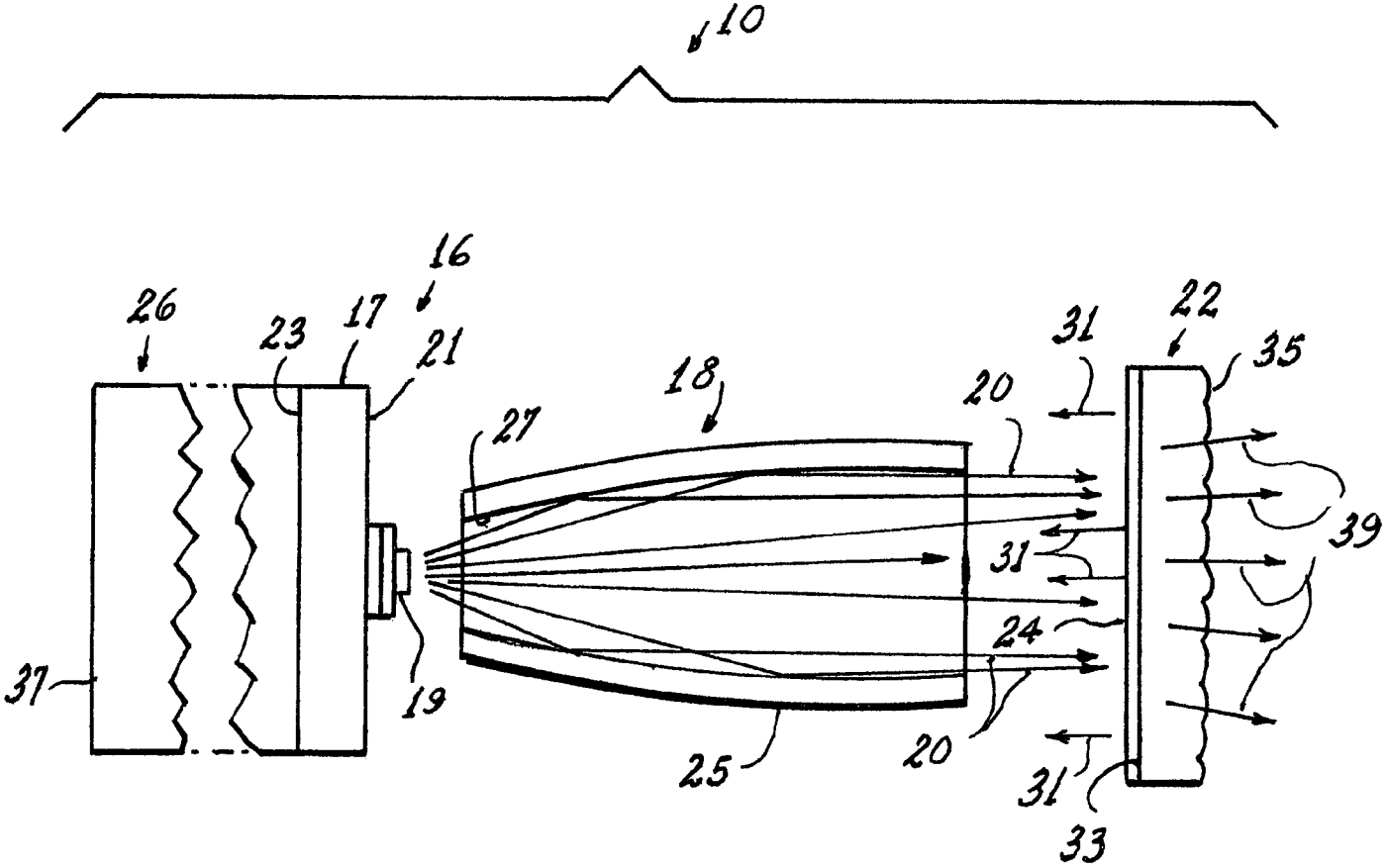
FIG. 1 is a diagrammatic view of an embodiment of the invention.
Figure 2:
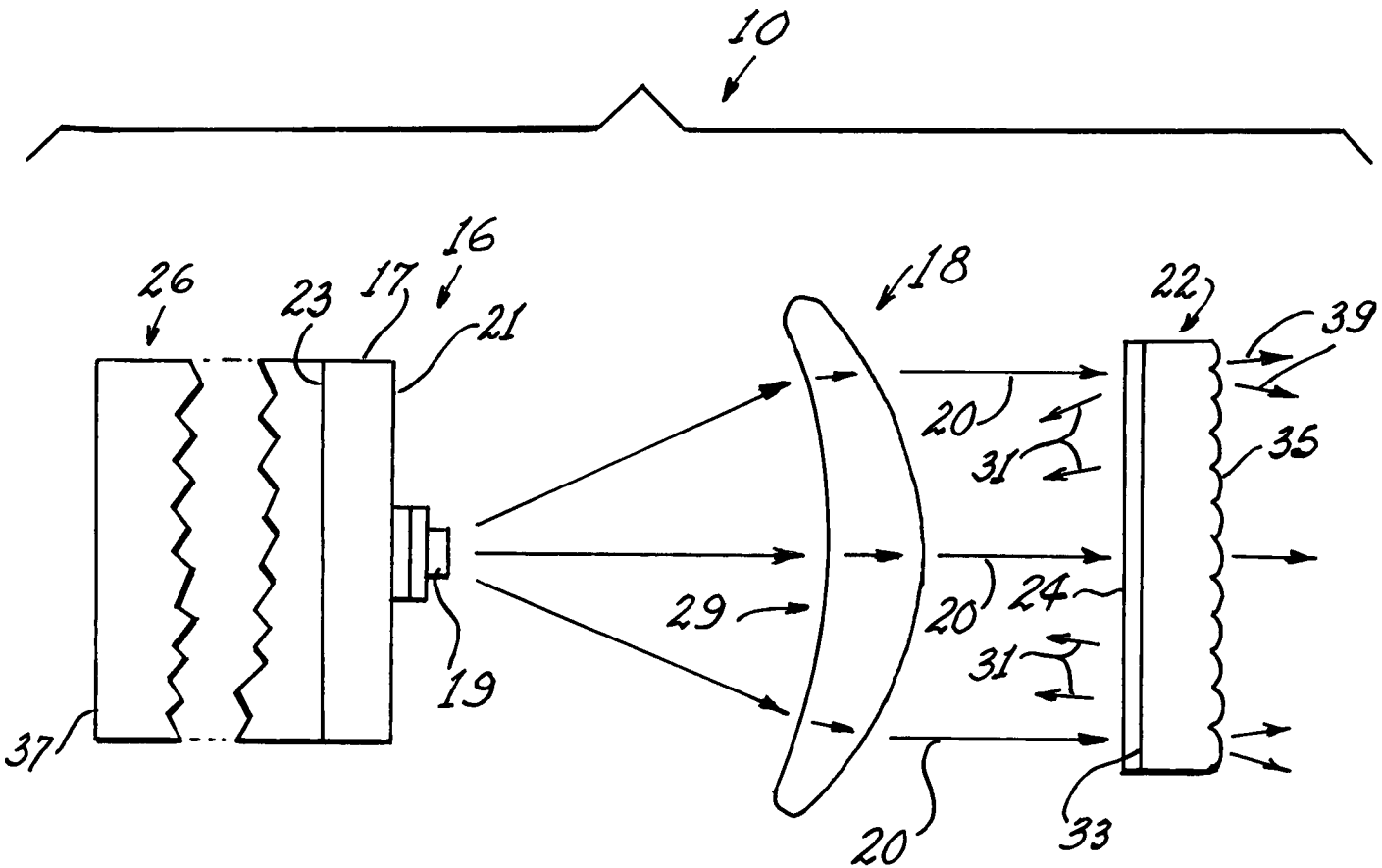
FIG. 2 is a similar view of an alternate embodiment of the invention.
Figure 3:
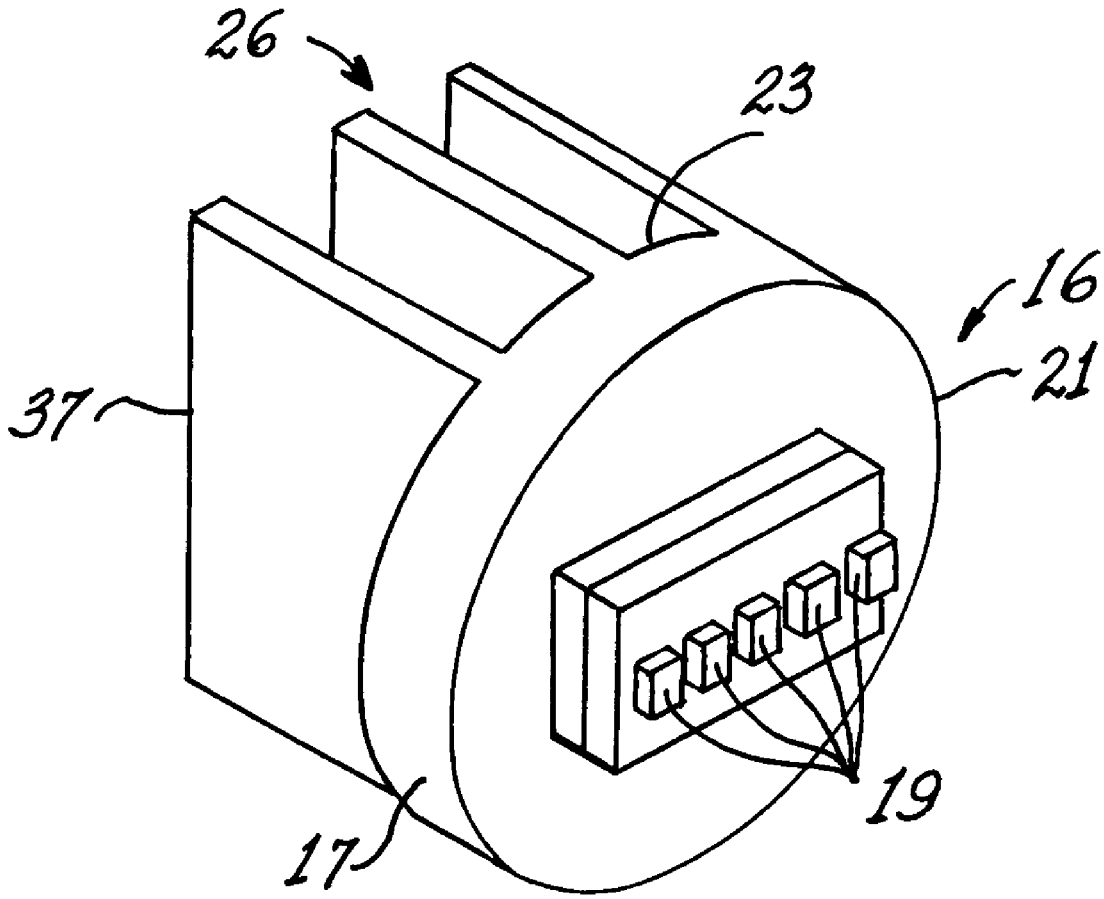
FIG. 3 is a perspective view of an LED assembly employed with the invention.

The lamp assembly 10 is shown more clearly in FIG. 1 and comprises an LED assembly 16 that emits, when operating, electromagnetic radiation 20, for example, white light that can include a wavelength range of 380 to 750 nm. Specifically, at least first and second wavelengths, 31, 39 are included. In the preferred embodiment the first wavelength 31 includes the range of 380 to 560 nm (blue-green) and the second wavelength 39 includes the range of 520 to 570 nm (yellow/orange). A collimating optic 18 is positioned forwardly of the LED assembly 16 for providing substantially parallel light rays of the radiation 20. A second optic 22 is positioned forwardly of the collimating optic 18, the second optic 22 having a first planar surface 33 facing the collimating optic 18 and a second, outer surface 35. The collimating optic 18 does not have a dichroic coating, that is, a coating which is understood in the art to selectively transmit and reflect different wavelengths. The first planar surface 33 has an interference coating 24 thereon, the interference coating 24 reflecting back toward the LED assembly 16 at least some of the first wavelengths 31 of the radiation 20 and transmitting at least some of the second wavelengths 39. The interference coating 24 is of substantially uniform thickness across planar surface 33. It is preferred that the uniform thickness of coating 24 has a variation of thickness of less than 7%.

The collimating optic 18, in a first embodiment, comprises a hollow member 25 displaying an inner, non-dichroic, reflective, parabolic surface 27.

In a second embodiment the collimating optic 18 comprises a concavo-convex lens 29.

The interference coating 24 is designed to work best with light incident angles close to 90 degrees, i.e., perpendicular to the surface on which they are impinging. The collimating optic advantageously contributes to this condition. If the light were not collimated to a substantially parallel bundle before hitting the interference coating, some of the green and blue light would pass through and shift the beam color away from the desired yellow, possibly to a range outside of the legal automotive yellow color box, specified in JAE/ECE. In the preferred embodiment of the invention, it is believed that a suitable interference coating 24 is the coating known from Table 1 of published European published application EP 0 986 093 A1, which is depicted in Tablet, below. The person of ordinary skill in the art will understand that the layers can be adjusted in both material and thickness to modify the reflected and transmitted wavelengths. The entire contents of EP 0 986 093 is hereby incorporated by reference.

TABLE 1

| INTERFERENCE FILTER COATING | | |
|---|---|---|
| LAYER NO. | LAYER TYPE | LAYER THICKNESS (nm) |
| 1 | $Fe_2O_3$ | 5.4 |
| 2 | $SiO_2$ | 78.9 |
| 3 | $TiO_2$ | 36.8 |
| 4 | $SiO_2$ | 73.5 |
| 5 | $TiO_2$ | 47.5 |
| 6 | $SiO_2$ | 73.5 |
| 7 | $TiO_2$ | 47.5 |
| 8 | $SiO_2$ | 73.5 |
| 9 | $TiO_2$ | 47.5 |
| 10 | $SiO_2$ | 73.5 |
| 11 | $TiO_2$ | 47.5 |
| 12 | $SiO_2$ | 73.5 |
| 13 | $TiO_2$ | 47.5 |

TABLE 1-continued

| INTERFERENCE FILTER COATING | | |
|---|---|---|
| LAYER NO. | LAYER TYPE | LAYER THICKNESS (nm) |
| 14 | $SiO_2$ | 69.9 |
| 15 | $TiO_2$ | 17.9 |
| 16 | $SiO_2$ | 32.3 |
| | | 846.2 |

The layer of $Fe_2O_3$ is an absorber layer, which mainly absorbs light from the blue and violet spectral region. The $SiO_2$ and $TiO_2$ layers present different, alternating dichroic layers, and when light strikes the interface some light goes forward and other light gets reflected backward. The net contribution from all interactions at the layers, given their selected thicknesses, when LED 16 is illuminated and light passes in the forward direction towards the exterior of lamp assembly 10, is that light of the selected wavelengths, here yellow, passes through in phase and other wavelengths, here blue-green, have been delayed and are out of phase and generally cancelled, so the eye perceives the intended yellow color. When LED 16 is not illuminated and exterior light or sunlight strikes the lamp assembly 10 in the reverse direction, then coating 24 in the reflective mode makes the yellow light out of phase and generally cancelled, but the blue-green light is in phase and perceived by the eye.

In the preferred embodiment, the LED assembly 16 comprises a heat-conducting substrate 17 including at least one but typically five white-light emitting LEDs 19 (for example, the white-light emitting LEDs can be comprised of blue emitting InGaN chips combined with a blue light sensitive phosphor) positioned on a forward facing surface 21. The actual number of LEDs will depend upon the efficiency of the individual LEDs. Preferably, the substrate 17 is composed of a suitable metal, such as aluminum.

The heat-conducting substrate 17 includes a rear-facing surface 23 provided with thermal structure 26 for cooling the light source. The thermal structure 26 can be heat-radiating fins 37, as shown, or other suitable structure; for example, the substrate can be water-cooled if desired.

In operation, the radiation 20 emitted by the LEDs (which, in the preferred embodiment is substantially white light, as previously described) is focused into substantially parallel rays by the collimating optic 18 to impinge upon the interference coating 24 on the rear surface 33 of the second optic 22. The nature of the interference coating (in the preferred embodiment) reflects back the blue and green portion of the white light spectrum but transmits the yellow portion, thus providing the distinctive yellow appearance to the turn signal indicator when it is illuminated.

During daylight, the turn signal indicator presents a blue-ish green appearance as the sunlight falling thereon has the blue-green portion of the spectrum reflected outwardly while the yellow portion passes through the optic 22.

Thus, the seemingly incompatible objects of designers and engineers (i.e., a turn signal indicator with a blue-green appearance when not illuminated and a vibrant yellow appearance when operating) are met with white light emitting LEDs, with all of the dependent benefits of that source of illumination, particularly, long life.

Although the specific embodiment described is preferably used with a yellow, frontal automotive display, it could be used on a rear display where permitted, and it should be understood that other selective wavelength combinations can be employed, such as for example a bright red transmitting coating for a rear automotive application. In order to generate a red transmitting coating, it is believed to be suitable to choose the coating disclosed in U.S. Pat. No. 6,661,164 (Ruemmelin) to be applied as interference coating 24' in lieu of the yellow interference coating 24 described above, in particular the coating described at col. 3, line 7 to col. 4, line 9, which refers to a uniform coating thickness applied at a 90 degree incident angle at the crest of the lamp as stated therein at col. 3, line 63. Coating 24' is understood to set the edge of the interference filtering at 590 nm. The entire contents of U.S. Pat. No. 6,661,164 are hereby incorporated by reference.

While there have been shown and described what are at present considered to be the preferred embodiments of the invention, it will be apparent to those skilled in the art that various changes and modifications can be made herein without departing from the scope of the invention as defined by the appended claims.

GLOSSARY OF REFERENCE NUMBERS USED HEREIN

10 signal indicator light source
12 forward portion of 14
14 vehicle
16 LED assembly
17 heat conducting substrate
18 collimating optic
19 radiation emitting LEDs
20 parallel rays of emitted radiation
21 forward surface of 16
22 second optic
23 rear facing surface of 16
24 interference coating
25 hollow optic
26 thermal structure for cooling
27 inner reflective surface of 25
29 concavo-convex lens
31 first wavelengths of the emitted radiation 20
33 planar surface on 22
35 outer surface on 22
37 heat-radiating fins
39 second wavelengths of the emitted radiation 20

What is claimed is:

1. A signal indicator lamp assembly (10) for a vehicle (14) comprising:

a LED assembly (16) that emits electromagnetic radiation (20) when operating, said electromagnetic radiation (20) comprising at least a first wavelength (31) and a second wavelength (39);

a collimating optic (18) positioned forwardly of said LED assembly (16) for providing substantially parallel rays of said emitted first and second wavelengths (31, 39);

a second optic (22) positioned forwardly of said collimating optic (18), said second optic (22) having a first planar surface (33) facing said collimating optic (18) and a second, outer surface (35), said first planar surface (33) having an interference coating (24) thereon, said interference coating (24) reflecting back toward said LED assembly (16) at least some of said first wavelengths (31) of said electromagnetic radiation (20) and transmitting at least some of said second wavelengths (39).

2. The signal indicator lamp assembly (10) of claim 1 wherein said collimating optic (18) comprises a hollow member (25) having an inner, reflective, parabolic surface (27).

3. The signal indicator lamp assembly (10) of claim 1 wherein said collimating optic (18) comprises a concavo-convex lens (29).

4. The signal indicator lamp assembly (10) of claim 1 wherein said LED assembly (16) comprises a heat-conducting substrate (17) including at least five LEDs (19) positioned on a forward facing surface (21).

5. The signal indicator lamp assembly (10) of claim 4 wherein said heat-conducting substrate (17) includes a rear-facing surface (23) provided with thermal structure (26) for cooling.

6. The turn signal indicator lamp assembly (10) of claim 5 wherein said thermal structure (26) for cooling comprises heat-radiating fins (37).

7. The signal indicator lamp assembly (10) of claim 1 wherein said first wavelength comprises radiation in the range of 380-560 nm and said second wavelength comprises radiation in the range of 520-570 nm.

8. The turn signal indicator lamp assembly (10) of claim 1 wherein said second wavelength comprises radiation above about 590 nm.

9. The signal indicator lamp assembly (10) of claim 2 wherein said inner, reflective, parabolic surface (27) is non-dichroic.

10. The signal indicator lamp (10) of claim 1 wherein said second wavelength comprises radiation in the range of 520-570 nm.

11. The signal indicator lamp assembly (10) of claim 1 wherein said first wavelength corresponds to blue-green light and said second wavelength corresponds to yellow-amber light.

* * * * *